US005730809A

United States Patent [19]

Tremmel

[11] Patent Number: 5,730,809

[45] Date of Patent: Mar. 24, 1998

[54] PASSIVATE FOR TUNGSTEN ALLOY ELECTROPLATING

[75] Inventor: Robert Tremmel, Grosse Ile, Mich.

[73] Assignee: Enthone-OMI, Inc., Warren, Mich.

[21] Appl. No.: 500,382

[22] Filed: Nov. 9, 1994

[51] Int. Cl.[6] ..... C23C 22/24

[52] U.S. Cl. ..... 148/264; 205/197

[58] Field of Search ..... 148/264; 205/197

[56] References Cited

U.S. PATENT DOCUMENTS 2,788,292 4/1957 Giesker ..... 148/264

3,098,775 7/1963 Thinsk ..... 148/264

3,266,900 8/1966 Zelley .

3,546,028 12/1970 Armstrong ..... 148/264

3,967,984 7/1976 Helwig ..... 148/264

*Primary Examiner*—Sam Silverberg

*Attorney, Agent, or Firm*—Harness, Dickey & Pierce, P.L.C.

[57] ABSTRACT

A passivate for tungsten alloy electroplates. The passivate includes an effective quantity of $CrO_3$ in an aqueous bath having a pH of from about 3.5 to about 7.5.

12 Claims, No Drawings

PASSIVATE FOR TUNGSTEN ALLOY ELECTROPLATING

BACKGROUND OF THE INVENTION

The present invention relates to tungsten alloy electroplate. More specifically, the present invention relates to passivation of tungsten alloy electroplates to increase tarnish and corrosion resistance.

Chromium plating for decorative and functional plating purposes has always been desirable. Most often chromium plating is carried out in hexavalent chromium electrolytes. Functional coatings from hexavalent chromium baths generally range in thickness from about 0.0002" to about 0200" and provide very hard, lubrous corrosion resistant coatings. Decorative coatings from hexavalent chromium electrolytes, are much thinner, typically 0.000005" to 0.000030", and are desirable because of their blue-white color and abrasion and tarnish resistance. These coatings are almost always plated over decorative nickel or cobalt or nickel alloys containing cobalt or iron.

The imposition of government restrictions on the discharge of toxic effluents, including hexavalent chromium present in conventional chromium plating baths, has escalated in recent years. Some state and local government restrictions are extremely stringent. This is especially the case with regard to fumes generated during the electrolysis of hexavalent chromium baths. In some locals even minuscule amounts of airborne chromium is unacceptable. This has prompted the development of alternative electroplating baths intended to approach the color and the characteristics of chromium deposits.

One possible solution is the electrodeposition of tungsten alloys. Typically, in such baths, salts of nickel, cobalt, iron or mixtures thereof are used in combination with tungsten salts to produce tungsten alloy deposits on various conductive substrates. In this case the nickel, cobalt and/or iron ions act to catalyze the deposition of tungsten such that alloys containing as much as 50% tungsten can be deposited, said deposits having excellent abrasion resistance, lubricity and acceptable color when compared to chromium.

However, while such deposits have been desirable as replacements for chromium, the properties of resulting deposits and inherent manufacturing limitations in prior art processes have not allowed such deposits to replace decorative or functional chromium deposits. Typically, such processes have resulted in very slow plating times or the deposits are non-uniform, making them undesirable for decorative applications.

However, with recent improvements in tungsten alloy electroplating the use of tungsten alloy electroplating in replacement applications for chromium plating has become closer to realization. For instance in my co-pending application entitled Additive for Tungsten Alloys filed Aug. 18, 1994, Ser. No. 08/292,610 I have taught a new bath for providing functional tungsten electroplates which are alloyed with nickel, iron, cobalt or mixtures of these. These baths operate at higher current densities and provide deposits with low internal stresses. These baths have provided a commercially feasible process for tungsten alloy electroplating. These tungsten alloys may be plated directly on a substrate such as steel, brass or copper. Additionally these alloys may be modified and plated directly over electroplates such as nickel and its alloys or, cobalt and its alloys to.

However, in my experimentation with such tungsten alloy electroplate, I have found these electroplates tend to tarnish when exposed to high humidity and/or salt treatments, regardless of the substrate. Thus in applications wherein the plate is going to be exposed to high humidity or corrosive agents, tungsten alloy electroplate has been susceptible to tarnishing and corrosion. Thus it has been a goal to provide some type of treatment for the tungsten electroplate which would increase tarnish and corrosion resistance.

In my U.S. Pat. No. 4,299,671 entitled Bath composition and Method for Electro Depositing Cobalt-Zinc Alloys Simulating a Chromium Plating the use of sodium dichromates and chromic acid is shown in the examples as a passivation treatment for cobalt zinc alloys. However, while passivation of such alloys as cobalt zinc, and cobalt tin is readily known in the art it has been readily accepted by those skilled in the art that passivation of tungsten and its alloys using chromates does not provide any significant beneficial effect to improve tarnish and corrosion resistance. Thus, when submitting tungsten plate to a solution of from 7.5 to 30 grams per liter $CrO_3$ having a pH of approximately 2 there is no significant improvement in the resistance to neutral salt spray tests. This corresponds to the readily accepted teachings in the art that tungsten and its alloys cannot readily be passivated by the chromic acid treatments or the like which have been utilized in the past.

Therefore, it has been a goal in the art to provide a passivation of tungsten alloy electroplate which will allow the use of these new electroplates in highly corrosive atmospheres, to provide more advantageous replacement of decorative and functional chromium alloys.

SUMMARY OF THE INVENTION

In accordance with the present invention there is provided a method for passivativing a tungsten alloy electroplate. In contrast to the teachings of the prior art the inventor of the present invention has discovered that the tungsten alloy electroplate may be passivated with an effective quantity of $CrO_3$ in a bath which has critical pH parameters of from about 3.5 to about 7.5. It has been found that operating in this range of pH results in a significant and unexpected increase in passivation of tungsten alloy electroplates. This results in a significant increase in tarnish and corrosion resistance as demonstrated by tungsten neutral salt spray tests. The increase in corrosion resistance and tarnish resistance versus the use of prior art passivating baths or untreated tungsten electroplate is significant and unexpected based on the teachings in the art.

Thus in accordance with the present invention the inventor has discovered that by use of the baths herein described, tungsten alloy electroplates may be passivated to improve corrosion and tarnish resistance, thereby allowing further uses for such electroplates in replacements for chromium deposits.

Other advantages and benefits of the present invention will be readily appreciated by those skilled in the art in light of the following description of the preferred embodiments, when taken in conjunction with the examples given below and the claims appended hereto.

DESCRIPTION OF THE PREFERRED EMBODIMENTS

In its broad aspects the present invention is accomplished by contacting a tungsten alloy electroplate with a passivating quantity of $CrO_3$ in a bath having a pH of from about 3.5 to about 7.5. The inventor has found that by controlling the pH of the bath, containing an effective amount of chromate, provides the unexpected result of greatly increasing the tarnish and corrosion resistance of tungsten alloy electroplates verses the use of standard chromate baths which typically have pH's of approximately 2 or lower. Examples exemplifying this unexpected result are set forth below.

In order for passivation to be accomplished it is first necessary to provide a substrate which includes a tungsten alloy electroplate thereon. Typically substrates such as steel, brass or copper may be plated over with tungsten alloy electroplates. However the present invention will also be useful when the tungsten electroplate is provided over other electroplates such as nickel an its alloys or cobalt and its alloys.

As stated above tungsten alloy electroplates are designed to replace decorative or hard chromium and therefore are typically used on substrates which are going to be exposed to corrosive conditions such as high humidity, salt or other corrosive agents, extended outdoor exposure or the like. While the present method is useful in many types of tungsten alloy electroplates, the present invention is particularly suitable for use in tungsten electroplate which is alloyed with iron, cobalt, nickel or mixtures of these. A suitable process for providing the tungsten electroplate is set forth in co-pending U.S. application Ser. No. 08/292,610, entitled Additive for Tungsten Alloys filed on Aug. 18, 1994, which is hereby incorporated herein by reference thereto. While the method of the present invention is useful in any tungsten alloy electroplate, the method is particularly suitable for use with tungsten cobalt alloys since these alloys seem particularly susceptible to tarnishing and corrosion.

The bath, in which the substrate having a tungsten alloy electroplate is passivated, must include an effective amount of $CrO_3$ in an aqueous solution. The source of the $CrO_3$ may come from chromic acid, potassium dichromate, sodium dichromate and mixtures thereof. Generally, these additives are contained in baths of the present invention in quantities of from about 1.8 to about 45 g/l. Such quantities of chromates have been found to provide effective passivating of tungsten alloy electroplate when following the teachings of the present invention. Typically baths in accordance with the present invention, include from about 7.5 to about 30 g/l and preferably from about 11 to about 19 g/l $CrO_3$ in the solution.

As stated above, baths of the present invention operate best in the general range of pH of from about 3.5 to about 7.5. Preferably the pH of passivating baths of the present invention will range from about 5 to about 6. It is critical in order to provide proper passivating, to maintain the pH in a range of from about 3.5 to about 7.5 during contacting of the substrate having the tungsten alloy electroplate with the bath. Typically, baths containing the chromate contents set forth above, must be adjusted to the operable range of pH. This may be accomplished by the addition of a source of a hydroxide ion in the bath. Thus any number of basic substances may be used as is known to those skilled in the art. Preferably, additions of sodium hydroxide, ammonium hydroxide, carbonates or mixtures thereof are added to the bath for adjusting of the pH into the critical range.

While baths of the present invention start showing beneficial results at temperatures of about 90° F., it is preferred to operate the baths of the present invention at elevated temperatures of from about 100° F. to about 180° F. This provides commercially practical treatment times, while providing maximum passivation of the alloys. While brief exposures to the bath will result in increased corrosion and tarnish resistance, typically contact with the bath will range from about 30 seconds to one minute, at temperature for providing optimum results. However, it has been found that retention times in the bath of up to 4 minutes may be accomplished with substantially no surface attack of the tungsten alloy electroplating. Preferably, the baths of the present invention are maintained at a temperature of from about 130° to about 160° F. for optimum results. It will be readily appreciated by those skilled in the art that time and temperature of the contacting of the substrate may be varied depending on the concentration of chromium in the bath and depending on the results desired to be obtained.

The substrates of the present invention may be contacted with the above described bath in any number of readily available ways such as immersion, spray application or any other method which provides contact of the bath with the surface.

The passivation method of the present invention allows use of tungsten alloy electroplates in high humidity or highly corrosive environments. Thus, for instance the electroplates, as treated in the present invention are useful in milling tools and/or hand tools and other equipment which require a hard surface and require properties of tarnish resistance and corrosion resistance which approach or are equal to chromium deposits.

Further understanding of the present invention will be had by reference to the following examples, which are presented herein for purposes of illustration but not limitation.

EXAMPLE I

A four liter cobalt-tungsten bath was prepared as follows:

| | |
|---|---|
| Cobalt Sulfate Heptahydrate | 40 g/L |
| Sodium Tungstate Dihydrate | 8 g/L |
| Citric Acid | 50 g/L |
| Sodium Sulfate | 25 g/L |
| 2 Ethyl Hexyl Sulfate | 0.4 g/L |
| Ammonium Hydroxide | to pH 7.5 |
| Temperature | 140° F. |

The plating cell contained stainless steel anodes and was connected to a 6 V DC rectifier. Typically, the alloy plated from this solution will be about 30–35% tungsten and the remainder cobalt.

A chromium containing passivate was made up as follows:

| | |
|---|---|
| Chromic Acid | 15.0 g/L |
| pH | Variable |
| Temperature | 160° F. |

4"×3" polished steel panels were plated in a commercial bright nickel bath to an average thickness of 0.00020". The nickel plated panels were then plated in the above-described alloy bath at about 15 ASF to an average tungsten cobalt plate thickness of about 0.000010". The panels were then immersed in the passivate described above for about 30 seconds to 1 minute. The pH of the passivate was varied to determine the effect of pH on corrosion protection. The panels were placed in a neutral salt spray(NSS) cabinette to evaluate resistance to surface staining and rusting of the steel substrate. This method of corrosion testing is described in ASTM Designation B 117. The test solution is 5% sodium chloride, pH 6.5–7.2, sprayed at a temperature of about 95° F. The results of the varied pH passivate are set forth below in Table 1

TABLE I pH v. APPEARANCE AFTER NSS EXPOSURE*

| pH | 16 hrs | 24 hrs | 48 hrs | 72 hrs | 120 hrs |
|---|---|---|---|---|---|
| 1.5 | sss | sss, rr | — | | |
| 2.0 | sss | sss, rr | — | | |
| 2.5 | sss | sss | sss, rr | — | |
| 3.0 | ss | sss | sss, rr | — | |
| 3.5 | lss | ss | sss | sss, lrr | — |
| 4.0 | lss | sss | sss | sss, lrr | — |
| 4.5 | ok | ok | ok | lss | sss |
| 5.0 | ok | ok | ok | lss | lss |
| 5.5 | ok | ok | ok | vlss | lss |
| 6.0 | ok | ok | ok | ok | lss |
| 6.5 | ok | ok | ok | lss | sss |
| 7.0 | ok | lss | sss | sss, rr | — |
| 7.5 | lss | sss | ss, rr | | — |
| 8.0 | sss | sss, rr | — | — | |

*CODE: vlss — very light surface stain, lss — light surface staining, ss — surface staining, sss — severe surface staining, lrr — light red rust, rr — red rust.

EXAMPLE II

Panels were plated and immersed in the passivate as described in Example I. However, this time the pH of the passivate was kept constant at 5.5 and the temperature of the passivate varied to determine the effect of temperature on corrosion protection. The results of the test are set forth below in the Table II.

TABLE II

TEMPERATURE v. APPEARANCE AFTER NSS EXPOSURE

| Temp | 16 hrs | 24 hrs | 48 hrs | 72 hrs | 120 hrs |
|---|---|---|---|---|---|
| 80 | sss | sss, rr | — | | |
| 90 | ok | sss | sss, rr | — | |
| 100 | ok | ok | sss, lrr | sss, rr | — |
| 110 | ok | ok | sss | sss, srr | sss, rr |
| 120 | ok | ok | lss | sss | sss, rr |
| 130 | ok | ok | ok | lss | ss, lrr |
| 140 | ok | ok | ok | lss | ss |
| 150 | ok | ok | ok | vlss | lss |
| 160 | ok | ok | ok | vlss | lss |
| 170 | ok | ok | ok | vlss | lss |

The above results indicate that as the temperature of the passivate increase overall corrosion protection improves.

EXAMPLE III

Panels were plated and immersed in the passivate as described in examples 1 and 2. However, this time the concentration of the chromic acid was varied to determine its effect on corrosion protection. The pH of the passivate was adjusted to 5.5 and the temperature was maintained at 160° F. The results of this test are set forth below in Table III.

TABLE III

CONCENTRATION v. APPEARANCE AFTER NSS EXPOSURE

| CONC** | 16 hrs | 24 hrs | 48 hrs | 72 hrs | 120 hrs |
|---|---|---|---|---|---|
| 0.5 | ok | iss | sss | sss, rr | sss, rr |
| 1.0 | ok | ok | iss | sss | sss, lrr |
| 1.5 | ok | ok | ok | lss | lss |
| 2.0 | ok | ok | ok | vlss | lss |

TABLE III-continued

CONCENTRATION v. APPEARANCE AFTER NSS EXPOSURE

| CONC** | 16 hrs | 24 hrs | 48 hrs | 72 hrs | 120 hrs |
|---|---|---|---|---|---|
| 3.0 | ok | ok | ok | ok | lss |
| 4.0 | ok | ok | ok | ok | vlss |

**Concentration is set forth in ounces of chromic acid/gallon of solution.

These test results indicate that as the concentration of the chromic acid increases corrosion protection improves.

EXAMPLE IV

A nickel tungsten plating bath was made up as follows:

| | |
|---|---|
| Nickel Sulfate Hexahydrate | 10.0 g/L |
| Sodium Tungsten Dihydrate | 55.0 g/L |
| Citric Acid | 60 g/L |
| Ammonium hydroxide | to pH of 8.0 |
| Temperature | 140° F. |

The plating cell contained stainless steel anodes and was connected to a 10 V DC rectifier. Typically, the alloy plated from this solution contains about 35–40% tungsten, the remainder nickel.

In 4"×3" polished steel panels were plated in the nickel tungsten alloy bath to an average thickness of about 0.00020". A pair of panels were air dried with no passivate. The rest of the panels were then passivated via immersion in the passivate described in example 1 with the pH adjusted to 5.5. In this example the nickel tungsten was not plated over nickel. Thus, the resulting coating is not decoratively appealing. It is, however, suitable for functional applications as a replacement for electroless nickel and hard chromium. The corrosion resistance was then evaluated in the NSS cabinette. The results of the test are set forth below in Table IV.

TABLE IV

PASSIVATED NICKEL TUNGSTEN ELECTROPLATE APPEARANCE AFTER NSS EXPOSURE

| No | Passivate | 24 hrs | 48 hrs | 72 hrs | 96 hrs |
|---|---|---|---|---|---|
| 1 | NONE | sss | sss, rr | — | |
| 2 | NONE | sss | sss, rr | — | |
| 3 | YES | ok | lss | lss | sss, rr |
| 4 | YES | ok | ok | lss | sss |
| 5 | YES | ok | vlss | lss | sss, rr |
| 6 | YES | ok | ok | vlss | sss |

These test results indicate that the passivate also improves the corrosion properties of nickel tungsten coatings.

The above examples indicate the relatively dilute solutions of hexavalent chromium salts will provide outstanding tarnish resistance and base metal corrosion protection when applied to alloys of tungsten and nickel, tungsten and cobalt or combinations thereof within the parameters specified above.

EXAMPLE V

An Iron Tungsten alloy plating bath is prepared as follows:

| | |
|---|---|
| Ferrous Sulfate Heptahydrate | 40 g/l |
| Sodium Tungstate | 50 g/l |
| Citric acid | 66 g/l |
| Salycilic acid | 150 mg |
| pH | 8.0 |
| Temperature | 140° F. |

A 3"×4" steel hull cell panel is plated in a 1 liter Hull Cell containing the above electrolyte. The panel is plated at 5 amps for 30 minutes. The resulting panel is lustrous.

The above panel is then passivated by immersion in the passivate described in Example 1 above. The resulting product is placed in the NSS salt spray booth and the panel is found to be resistant to tarnishing or staining for about 48 hours.

While the above specification and exemplification was given for purposes of disclosing the preferred embodiments of the present invention, it is not to be construed to be limiting of the present invention.

Therefore, it will be readily appreciated by those skilled in the art that the present invention can be practiced other than as specifically stated. Thus, the invention may be subject to modification, variation and change without departing from the proper scope and fair meaning of the accompanying claims.

What is claimed:

1. A method for passivating tungsten alley electroplate comprising contacting said tungsten alley electroplate with a passivating quantity of $CrO_3$ in an aqueous bath solution having a pH of from about 4.5 to about 7.5, wherein said bath includes a source for providing $CrO_3$ in quantities of from about 1.8 to about 45 g/l of $CrO_3$, and further wherein said bath is maintained at a temperature of from about 100° F. to about 180° F. for passivation.

2. The method of claim 1 wherein said bath includes a source for providing $CrO_3$ in quantities of from about 7.5 to about 30 g/l.

3. The method of claim 1 wherein said bath includes a source for providing $CrO_3$ in quantities of from about 11 to about 19.

4. The method of claim 1 wherein said source of $CrO_3$ is selected from the group consisting of chromic acid, potassium dichromate, sodium dichromate, sodium chromate, potassium chromate and mixtures thereof.

5. The method of claim 2 wherein said source of $CrO_3$ is selected from the group consisting of Chromic acid, potassium dichromate, sodium dichromate, sodium chromate, potassium chromate and mixtures thereof.

6. The method of claim 3 wherein said source of $CrO_3$ is selected from the group consisting of chromic acid, potassium dichromate, sodium dichromate, sodium chromate, potassium chromate, and mixtures thereof.

7. The method of claim 1 wherein said pH is from about 5 to about 6.

8. A method for passivating a tungsten alloy electroplate comprising:

a. Providing a substrate including an electroplated layer of a tungsten alloy selected from the group consisting of tungsten, alloyed with cobalt, nickel, iron and mixtures thereof:

b. Providing a passivating bath including from about 1.8 to about 45 g/l of $CrO_3$ with a pH of from about 4.5 to about 7.5 and maintained at a temperature of from about 100° F. to about 180° F.;

c. contacting the substrate with the passivating bath for passivating of the tungsten alloy electroplate.

9. The method of claim 8 wherein said pH is from about 5 to about 6.

10. The method of claim 8 wherein the temperature of the bath is from about 130° F. to about 160° F.

11. The method of claim 8 wherein $CrO_3$ is contained in the bath in quantities of from about 7.5 to about 30 g/l.

12. The method of claim 8 wherein $CrO_3$ is contained in the bath in quantities of from about 11 to about 19 g/l.

* * * * *

UNITED STATES PATENT AND TRADEMARK OFFICE

CERTIFICATE OF CORRECTION

PATENT NO. : 5,730,809

DATED : March 24, 1998

INVENTOR(S) : Robert Tremmel

It is certified that error appears in the above-identified patent and that said Letters Patent is hereby corrected as shown below:

Column 1, Line 13, " 0200" " should be --0.020"--

Column 1, Line 64, "to." should be --too.--

Column 2, Line 7, "composition" should be --Composition--

Column 3, Line 10, "an" should be --and--

Column 4, Line 5, "130°" should be --130° F--

Column 6, Line 57, after "indicate" insert --that--

Column 7, Line 29, "alley" should be --alloy--

Column 7, Line 30, "alley" should be --alloy--

Column 8, Line 9, "Chromic" should be --chromic--

Column 8, Line 20, "Providing" should be --providing--

UNITED STATES PATENT AND TRADEMARK OFFICE

CERTIFICATE OF CORRECTION

PATENT NO. : 5,730,809

DATED : March 24, 1998

INVENTOR(S) : Robert Tremmel

It is certified that error appears in the above-identified patent and that said Letters Patent is hereby corrected as shown below:

Column 8, Line 23, "thereof:" should be --thereof;--

Column 8, Line 24, "Providing" should be --providing--

Signed and Sealed this

Twenty-first Day of July, 1998

*Attest:*

*Attesting Officer*

BRUCE LEHMAN

*Commissioner of Patents and Trademarks*